US009666963B2

(12) United States Patent
He et al.

(10) Patent No.: US 9,666,963 B2
(45) Date of Patent: May 30, 2017

(54) TERMINAL, ELECTRIC CONNECTOR AND ELECTRIC CONNECTOR ASSEMBLY

(71) Applicant: Tyco Electronics (Shanghai) Co. Ltd., Shanghai (CN)

(72) Inventors: Jiayong He, Shanghai (CN); Shengyu Wu, Shanghai (CN); Wenke He, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/689,234

(22) Filed: Apr. 17, 2015

(65) Prior Publication Data

US 2015/0303597 A1 Oct. 22, 2015

(30) Foreign Application Priority Data

Apr. 17, 2014 (CN) ..... 2014 1 0154219

(51) Int. Cl.

*H01R 12/00* (2006.01)
*H01R 12/71* (2011.01)
*H01R 12/70* (2011.01)

(52) U.S. Cl.

CPC ..... *H01R 12/716* (2013.01); *H01R 12/7088* (2013.01)

(58) Field of Classification Search

USPC ..... 439/74

See application file for complete search history.

(56) References Cited

U.S. PATENT DOCUMENTS 8,556,640 B2 * 10/2013 Mashiyama ..... H01R 12/73 439/74
8,845,339 B2 * 9/2014 Ono ..... H01R 12/7052 439/74
8,961,215 B2 * 2/2015 Hasegawa ..... H01R 9/091 439/346
9,147,969 B2 * 9/2015 Takenaga ..... H01R 13/6275
9,356,371 B2 * 5/2016 Goto ..... H01R 12/73
9,391,398 B2 * 7/2016 Omodachi ..... H01R 12/707

* cited by examiner

*Primary Examiner* — Tho D Ta
(74) *Attorney, Agent, or Firm* — Barley Snyder

(57) ABSTRACT

A receptacle terminal is provide and includes a first U-shape section. The first U-shape section has a downward opening and includes a base, a first lateral arm, and a pair of extending arms. The base extending laterally thereof and the first lateral arm faces the base. The pair of extending arms is bent substantially perpendicularly towards the first lateral arm at both lateral ends of the base.

21 Claims, 8 Drawing Sheets

TERMINAL, ELECTRIC CONNECTOR AND ELECTRIC CONNECTOR ASSEMBLY

CROSS-REFERENCE TO RELATED APPLICATION

This application claims the benefit of the filing date under 35 U.S.C. §119(a)-(d) of Chinese Patent Application No. 201410154219.7 filed on Apr. 17, 2014 in the State Intellectual Property Office of China, the whole disclosure of which is incorporated herein by reference.

FIELD OF THE INVENTION

The invention relates to an electric terminal and, in particular, an electrical terminal for an electrical connector connecting to a circuit boards.

BACKGROUND

In an electronic apparatus such as cell phone, printer, digital camera, camera, GPS device, tablet computer, personal computer or the like, in order to facilitate operation, known board-to-board electrical connectors is generally required to electrically connect two printed circuit boards (PCB), such that power signals and data signals are transmitted between the two circuit boards. The current transmission by these board-to-board electrical connectors is generally small, which is typically about 2 A (ampere), and does not meet transmission requirements for current mobile communication equipment.

SUMMARY

In order to address the above or other problems, embodiments of the invention provide a receptacle terminal is provided and includes a first U-shape section. The first U-shape section has a downward opening and includes a base, a first lateral arm, and a pair of extending arms. The base extending laterally thereof and the first lateral arm faces the base. The pair of extending arms is bent substantially perpendicularly towards the first lateral arm at both lateral ends of the base.

BRIEF DESCRIPTION OF THE DRAWINGS

The objectives, features and advantages of the present invention will become more apparent by explaining further the present invention with reference to the accompanying drawings and detailed embodiments in the following, in which.

DETAILED DESCRIPTION OF THE EMBODIMENT(S)

Figure 1:
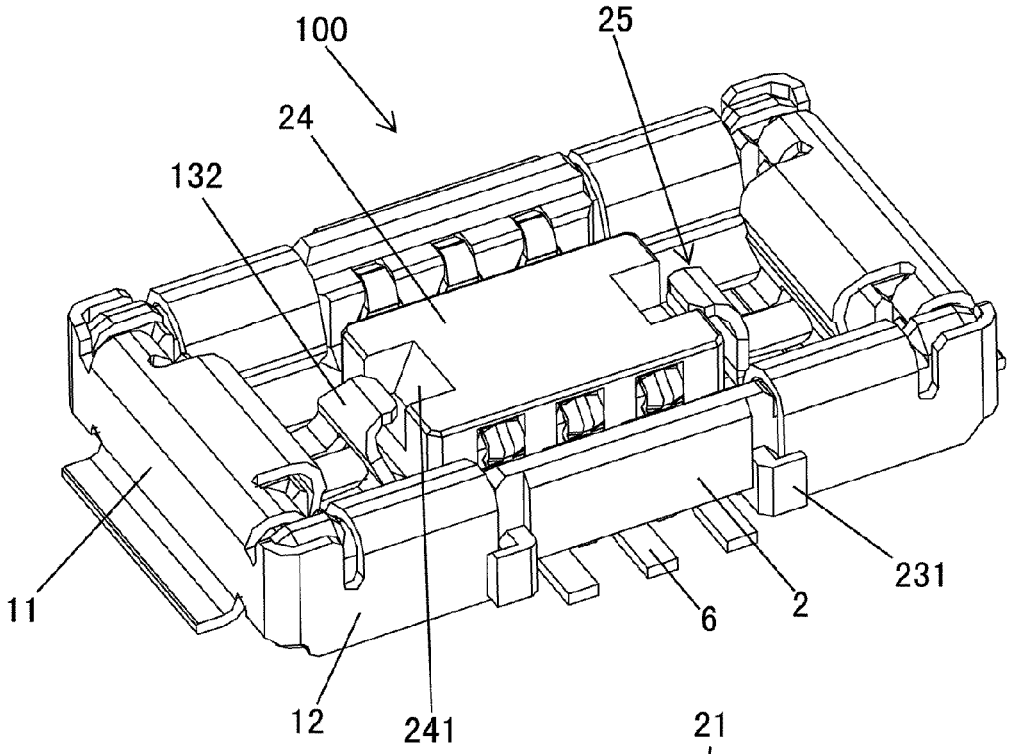
FIG. 1 is a top perspective view of a receptacle connector of an electrical connector according to the invention.

Although preferable embodiments of the present invention will be described with reference to the attached drawings in order to provide a thorough understanding of the invention, it should be appreciated that those skilled in the art can modify the present invention described herein and obtain the effect of the present invention. Thus, it should be noted that the above description is a broader disclosure for those skilled in the art, and the contents thereof are not limited to embodiments of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As shown in FIG. 1, an electric connector according to the invention may be applied to electronic apparatus such as cell phone, printer, digital camera, camera, GPS device, tablet computer, personal computer or the like. The electric connector assembly is configured to electrically connect a circuit board to a mating circuit board, and named as a board-to-board connector. The electric connector assembly includes a receptacle connector 100 and a plug connector 200 mounted on the two circuit boards, respectively, which are used to connect electrically the two circuit boards such as printed circuit board (PCB) to transmit power signals and data signals between the two circuit boards.

As shown in FIG. 1, FIG. 2, FIG. 5 and FIG. 6, the receptacle connector 100 according to an embodiment of the invention is to be mounted on one of the two circuit boards (not shown) to be connected. The receptacle connector 100 includes a housing 2 and one or more receptacle terminals 1 mounted on the housing. The receptacle terminal 1 is used as a power terminal for transmitting power signals.

For the sake of understanding easily, based on an arrangement state of the receptacle connector 100 as shown in FIG. 1, directions in which the length, width and height (or thickness) of the receptacle connector extend are called as longitudinal direction, lateral direction and up-down direction, respectively, and a side of each part close to the center of the receptacle connector 100 is called as an inner side while a side away from the center thereof is called as an outer side.

Figure 3:
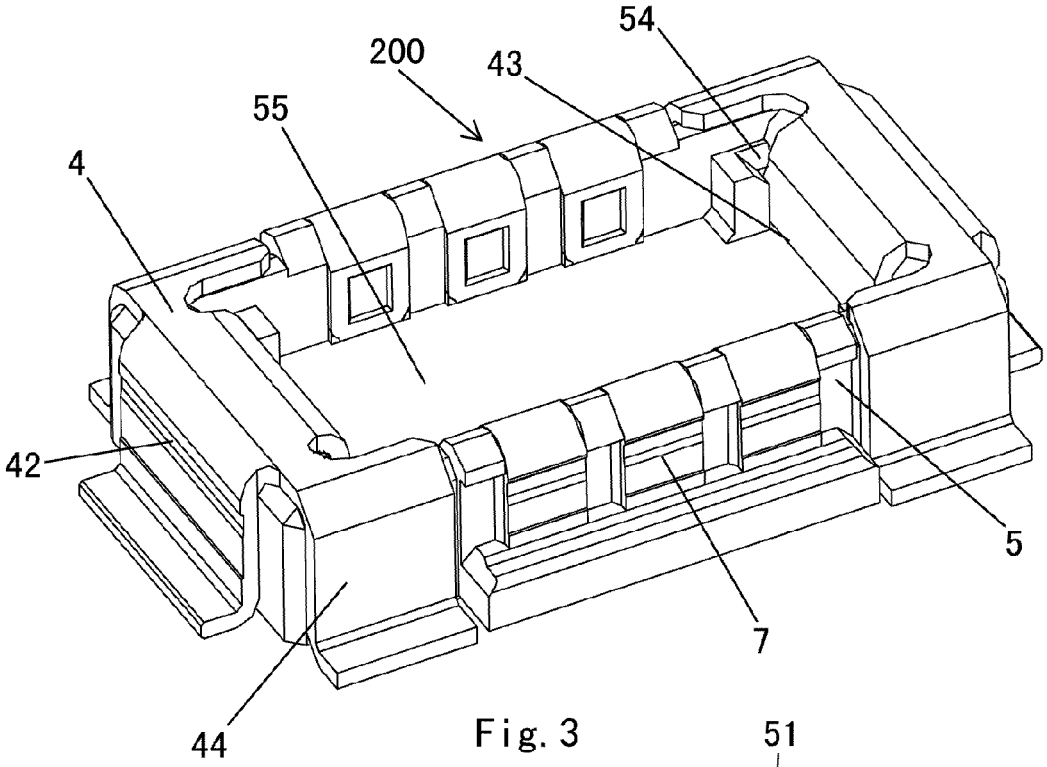
FIG. 3 is a top perspective view of a plug connector of an electrical according to the invention.
Figure 4:
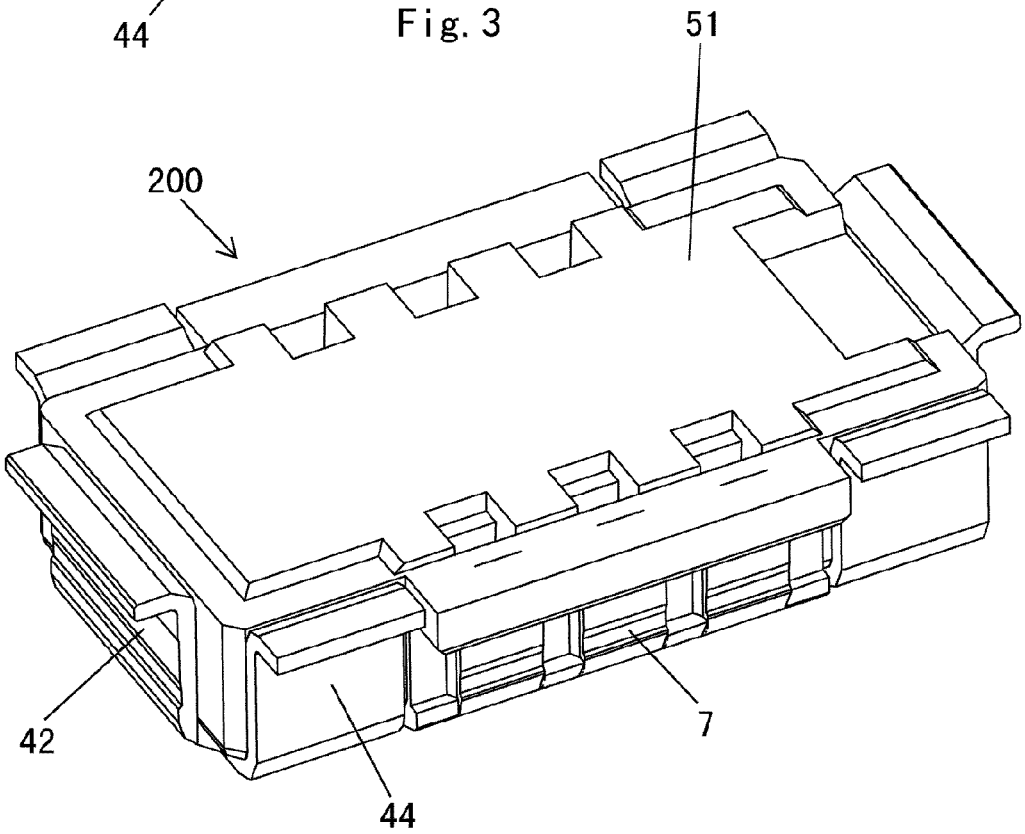
FIG. 4 is a bottom perspective view of the plug connector of FIG. 3.

In an embodiment of the invention, the housing 2 is formed of insulation material such as plastic material or the like. The housing includes a bottom 21 having a substantial rectangle shape, and a looped frame formed by extending upward from a periphery of the bottom. The looped frame defines a receiving part 25 for receiving the plug connector 200 (described in detail hereafter) as shown in FIGS. 3 and 4.

According to an embodiment of the invention, as shown in FIGS. 1, 5, 10 and 12, each receptacle terminal 1 is formed from a single metal piece, for example, by shearing, punching, bending process. The receptacle terminal 1 includes a first U-shape section 111 having a downward (i.e. towards the bottom 21 of the housing 2) opening and two extending arms 12. The first U-shape section 11 includes a base 11 extending laterally and a first lateral arm 112 facing with the base 11. The first U-shape section 111 covers a lateral frame 22 of the looped frame, that is, the lateral frame 22 is received in the first U-shape section 111. Two extending arms 12 are bent substantially perpendicularly towards the first lateral arm 112 at both lateral ends of the base 11.

In the embodiment, a second U-shape section 121 is provided and includes a downward opening is bent at an upper side of each extending arm 12 and covers a longitudinal frame 23 of the looped frame, that is, a part of the longitudinal frame 23 is received in the second U-shape section 121. A first contact section 1221 is formed on each of facing sides of two first longitudinal arms 122, which is located along inner sides of the extending arms 12 of the second U-shape section 121.

Figure 10:
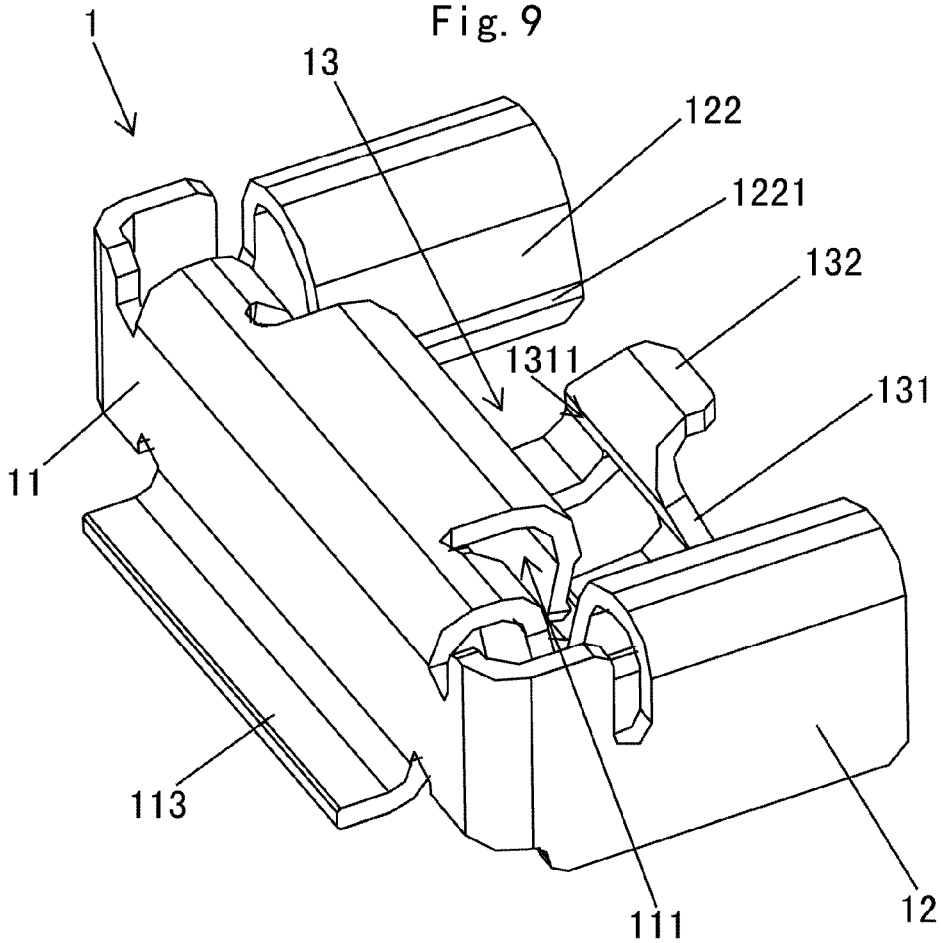
FIG. 10 is a perspective view of another terminal according to the invention.
Figure 12:
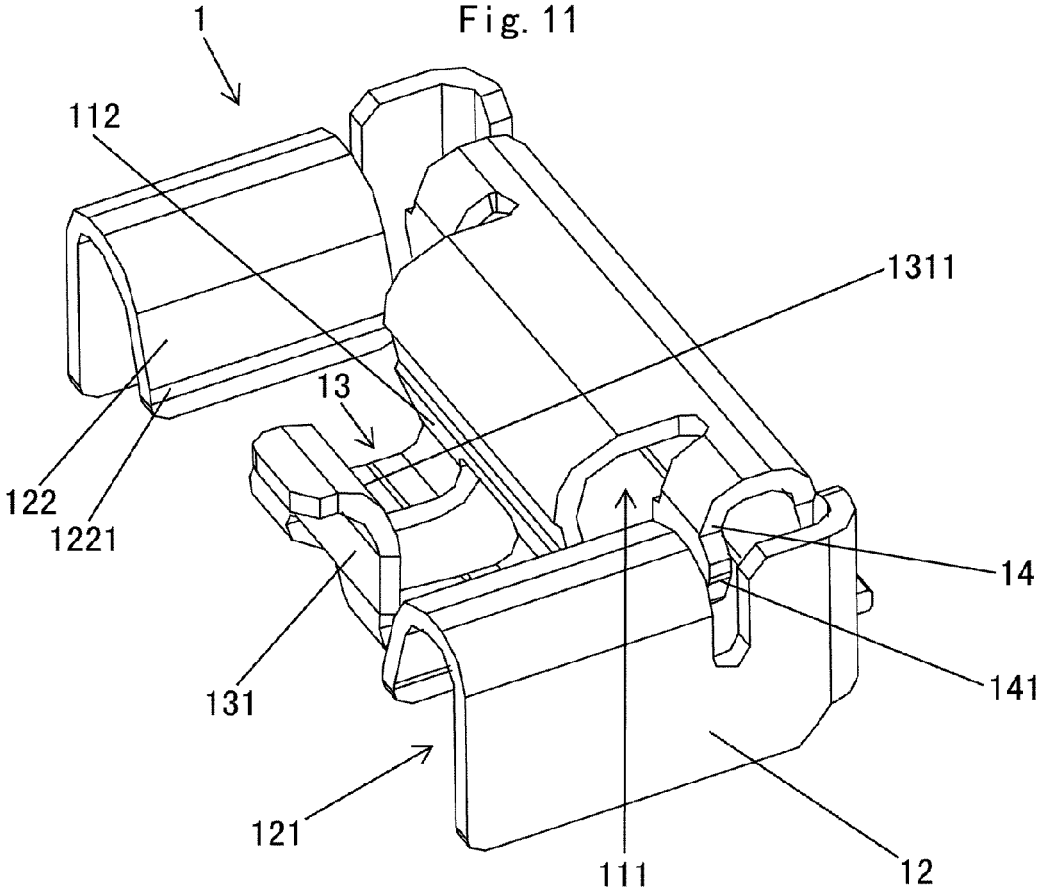
FIG. 12 is another perspective schematic view of the terminal of FIG. 10.

As shown in FIGS. 10 and 12, the receptacle terminal 1 further includes a third U-shape section 13 which is bent outward the first lateral arm 112 at an inner side of the first U-shape section 111 and has an upward opening. In other words, the first lateral arm 112 is common to the first U-shape section 111 and the third U-shape section 13, and the upward opening of the first U-shape section 111 is opposite to the downward opening of the third U-shape section 13.

Further, the third U-shape section 13 includes the first lateral arm 112, and a second lateral arm 131 positioned along an inner side of the first lateral arm 112, opposite the first lateral arm 112. A second contact section 1311 is formed on each of two facing sides of the first lateral arm 112 and the second lateral arm 131.

In the shown embodiment, a free end of the second lateral arm 131 is formed as a tongue 132 extending outward from the second lateral arm 131.

Figure 5:
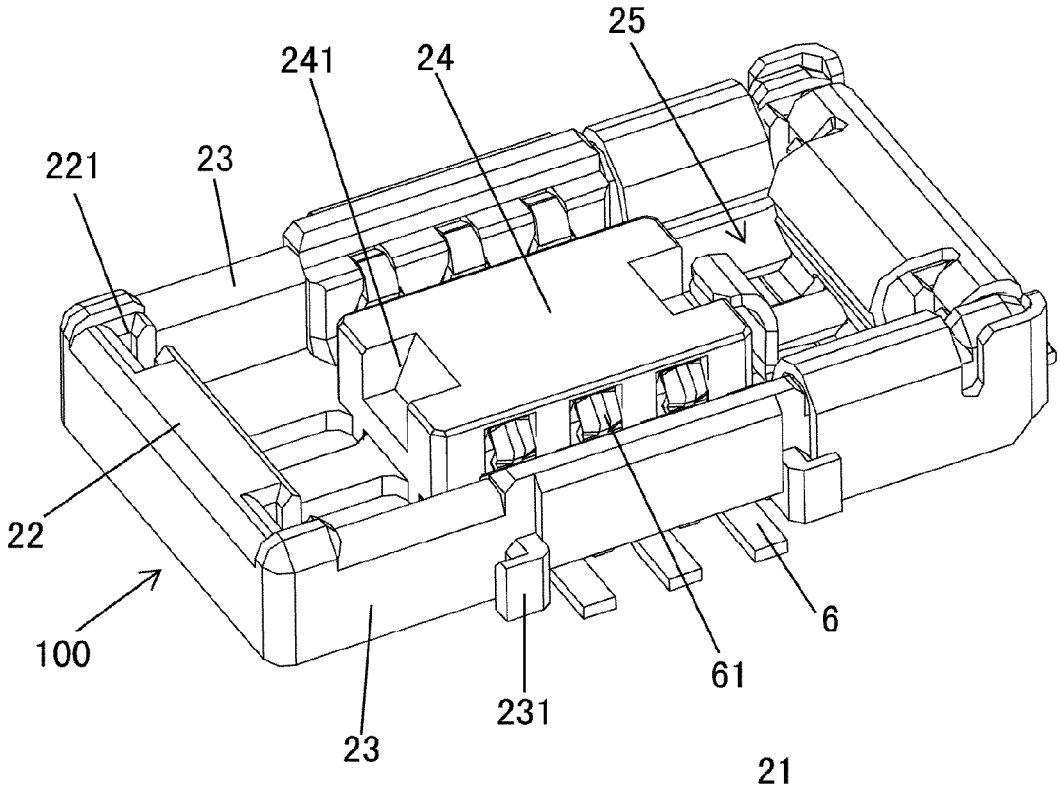
FIG. 5 is a perspective view of the receptacle connector of FIG. 1 after removing a terminal.

Referring to FIGS. 1 and 5, the receptacle connector 100 further includes a boss 24 disposed at the center of the bottom 21 of the housing 2, a gap is formed between the periphery of the boss 24 and the inner side of the looped frame. A restricting groove 241 is formed at each of both longitudinal ends of the boss 24, and the tongue 132 is slidably disposed in the restricting groove 241, such that a maximum distance by which the tongue 132 moves outwards is restricted.

In a further embodiment of the receptacle connector 100, referring to FIGS. 1, 5, and 12, an engaging section 14 is a part bent and extending downward between each end of the first U-shape section 111 and each extending arm 12, and an engaging groove 221 for receiving the engaging section 14 is formed in the lateral frame 22. At least one protrusion 141 is formed on the engaging section 14. As a result, when the receptacle terminal 1 is mounted into the housing 2 from an upper portion of the housing 2 as shown in FIG. 5, the first U-shape section 111 covers the lateral frame 22 while the engaging section 14 is inserted into the engaging groove 221. The protrusions 141 of the engaging section 14 may be elastically deformable along a surface of the inner walls of the engaging groove 221, so that the receptacle terminal 1 is held on the housing 2 relatively tightly.

Figure 2:
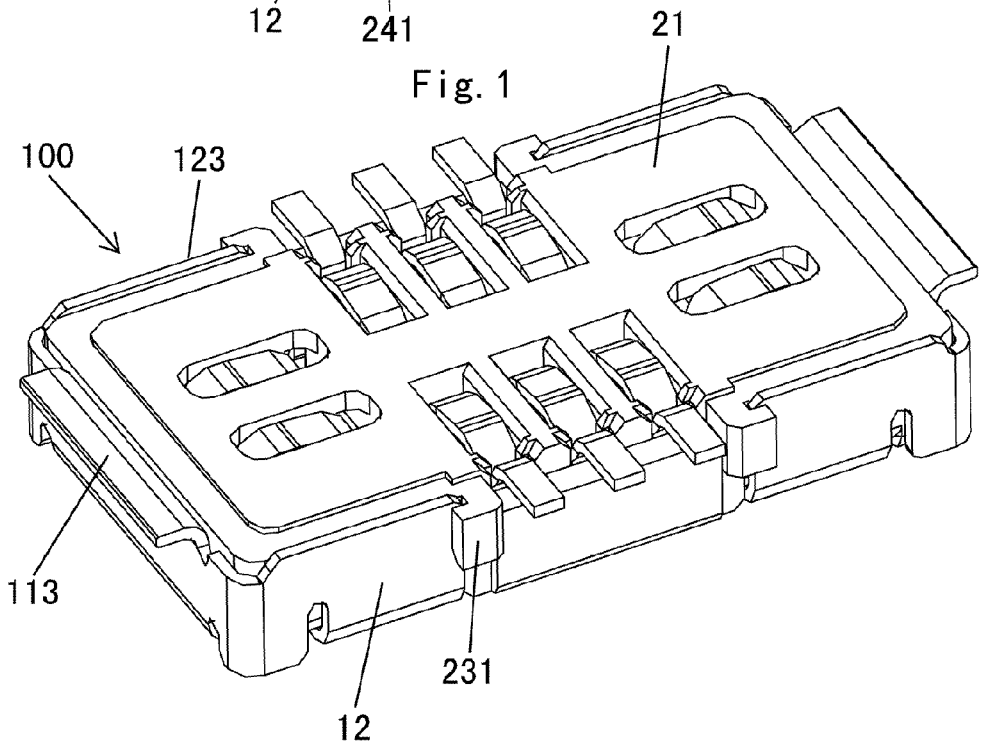
FIG. 2 is a bottom perspective view of the electrical connector of FIG. 1.

In a further embodiment of the receptacle connector 100, referring to FIGS. 1, 2 and 5, a plurality of restricting hooks 231 are provided along outer sides of the longitudinal frames 23. A part of each extending arm 12 is arranged to extend into the restricting hook 231 to prevent the extending arm 12 from offsetting outward, so that the extending arm 12 rests tightly against the outer side of the longitudinal frames 23.

Figure 6:
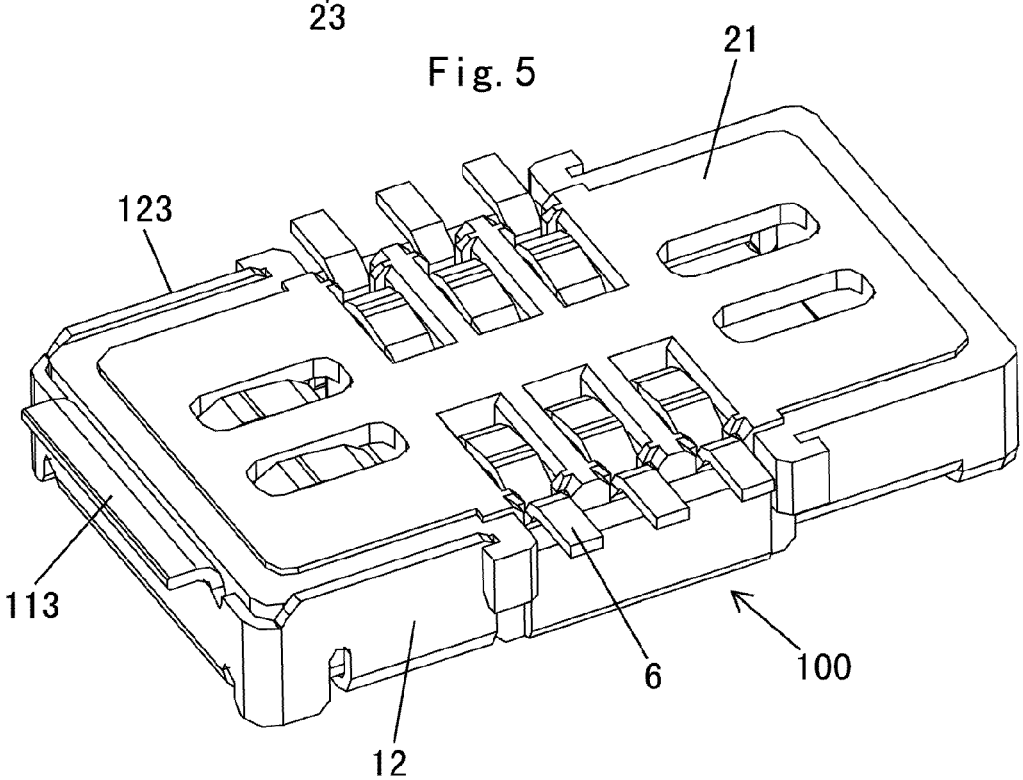
FIG. 6 is a perspective view of the receptacle connector of FIG. 2 after removing the terminal.

As shown in FIGS. 2 and 6, lower sides of the base 11 and the two extending arms 12 extend out of the lower surface of the bottom to form welding parts 123 for welding onto the circuit board (not shown). In addition, lower side of the base 11 opposite to the first lateral arm is bent outward to form a planar contact section 113 in order to transmit a larger current. As such, the welding parts 123 of extending arms cannot only be welded onto planar contact sections of the circuit board but also be inserted into slots formed in the circuit board, and the planar contact section 113 may be connected electrically to a planar contact section on the circuit board. In the present invention, two welding parts 123 of extending arms and the planar contact section 113 form three output interfaces through which a current may be transmitted to the circuit board, so that a larger current, for example, a current up to about 15 A, may be transmitted, the capacity of transmitting current by the board-to-board connector is thus increased.

Now with reference to FIGS. 3, 4, 7-9, 11 and 13-15, the plug connector 200 is shown and mate with the receptacle connector according to the invention.

The plug connector 200 includes a mating housing 5 and a mating terminal 4 or two mating terminals 4 mounted on the mating housing 5. The mating terminal 4 is used as a power terminal for transmitting power signals.

In the shown embodiment, the mating housing 5 is formed of insulation material such as plastic material or the like. The mating housing 5 includes a mating bottom 51 having a substantial rectangle shape, and a mating looped frame formed by extending from periphery of the mating bottom. The mating looped frame includes two mating lateral frames 52 and two mating longitudinal frames 53. The mating looped frame defines a mating receiving part 55 for receiving the boss 24 of the receptacle connector 100 (shown in FIG. 1).

Figure 9:
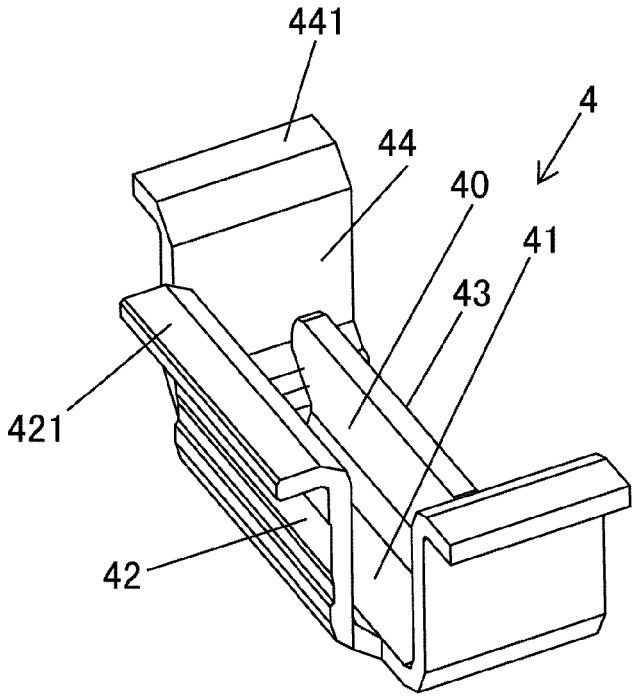
FIG. 9 is a perspective view of a mating terminal according the invention.

According to the embodiment shown in FIGS. 9 and 10, each mating terminal 4 is formed from a single metal piece, for example, by shearing, punching, bending process. The mating terminal 4 includes a fourth U-shape section 40 for covering one mating lateral frame 52 of the mating looped frame. Further, the mating terminal 4 includes a mating base 41, and a first mating lateral arm 42 and a second mating lateral arm 43 connected with two sides of the mating base 41, respectively. The mating lateral frame 52 of the plug connector 200 is received in the fourth U-shape section 40. The first mating lateral arm 42 and the second mating lateral arm 43 are bent substantially perpendicularly at both lateral sides of the mating base 41.

Referring to FIGS. 1-8 and 13-15, when the plug connector 200 is coupled with the receptacle connector 100, the plug connector 200 is inserted into the receiving part 25 of the receptacle connector 100. More specifically, the mating lateral frame 52 of the plug connector 200 is received in the gap between the periphery of the boss 24 of the receptacle connector 100 and the inner side of the looped frame, and the first lateral arm 112 of the first U-shape section 111 located at the inner side of the lateral frame 22 is kept electrical contact with the first mating lateral arm 42 of the fourth U-shape section 40 located at the outer side of the mating lateral frame 52, as a result, a first electric contact section is formed.

As shown in FIGS. 10 and 12, each extending arm 12 of the receptacle connector 100 includes a second U-shape section 121 having a downward opening, which covers a longitudinal frame 23 of the looped frame. On the other hand, the mating terminal 4 further includes two mating extending arms 44 which are constructed to be rested against outer sides of mating longitudinal frames 53 of the mating looped frame, and the two mating extending arms 44 come into electrical contact with two first longitudinal arms 122 located along inner sides of the extending arms 12, respectively, when the plug connector 200 is coupled with the receptacle connector 100, as a result, a second electric contact section is formed.

In the shown embodiment, the receptacle terminal 1 further includes the third U-shape section 13 which is bent outward the first lateral arm 112 located at the inner side of the first U-shape section 111 and has an upward opening. The opening of the third U-shape section 13 is opposite to the openings of the first and second U-shape section. When the plug connector 200 is coupled with the receptacle connector 100, the fourth U-shape section 40 of the mating terminal 4 is received in the third U-shape section 13, and a second mating lateral arm 43 of the fourth U-shape section 40 located in an inner side of the mating lateral frame 52 comes into electrical contact with the second lateral arm 131 of the third U-shape section 13, as a result, a third electric contact section is formed.

Figure 7:
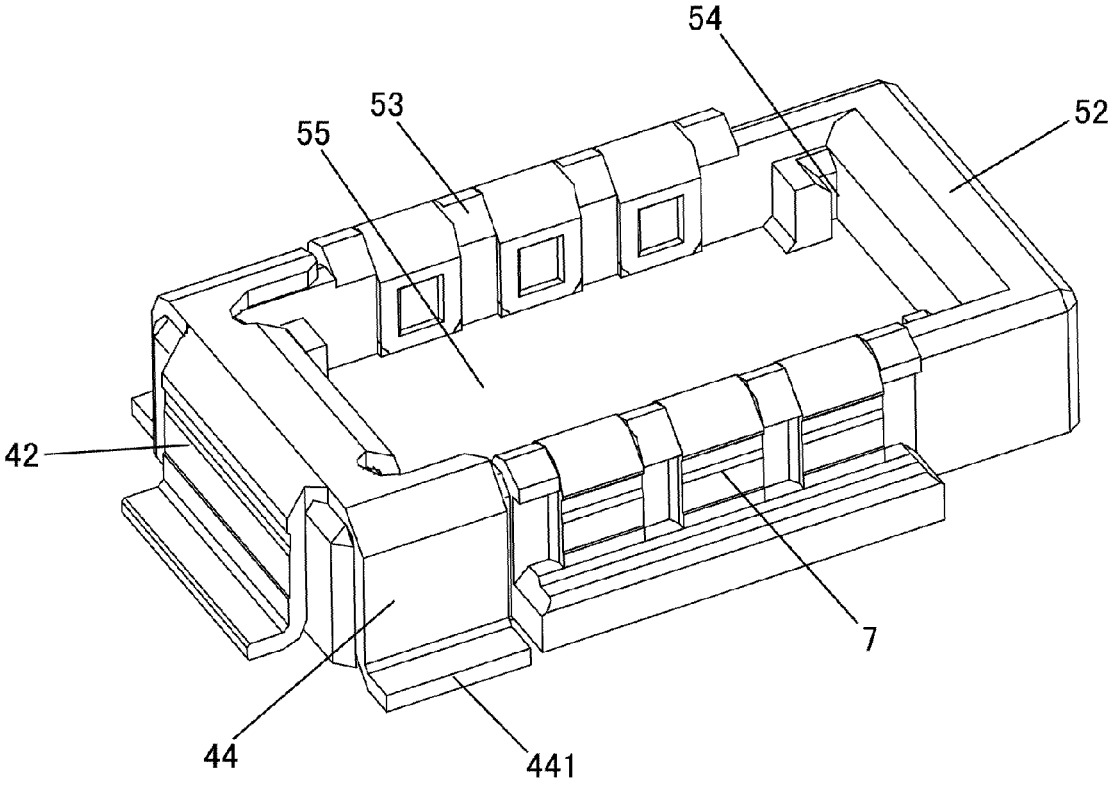
FIG. 7 is a perspective view of the plug connector of FIG. 3 after removing a mating terminal.
Figure 8:
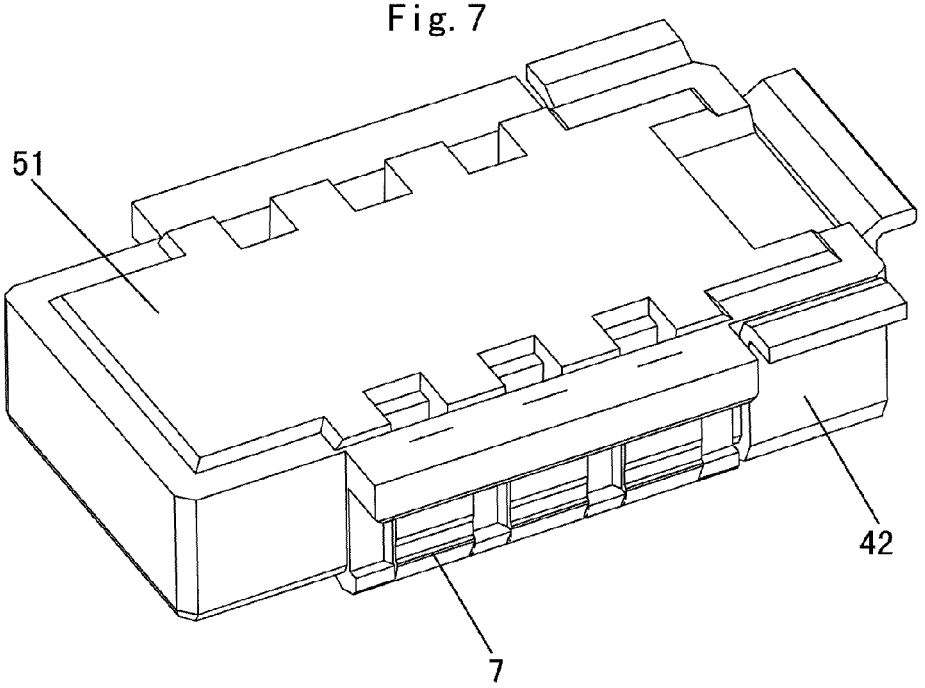
FIG. 8 is a perspective view of the plug connector of FIG. 4 after removing the mating terminal.
Figure 11:
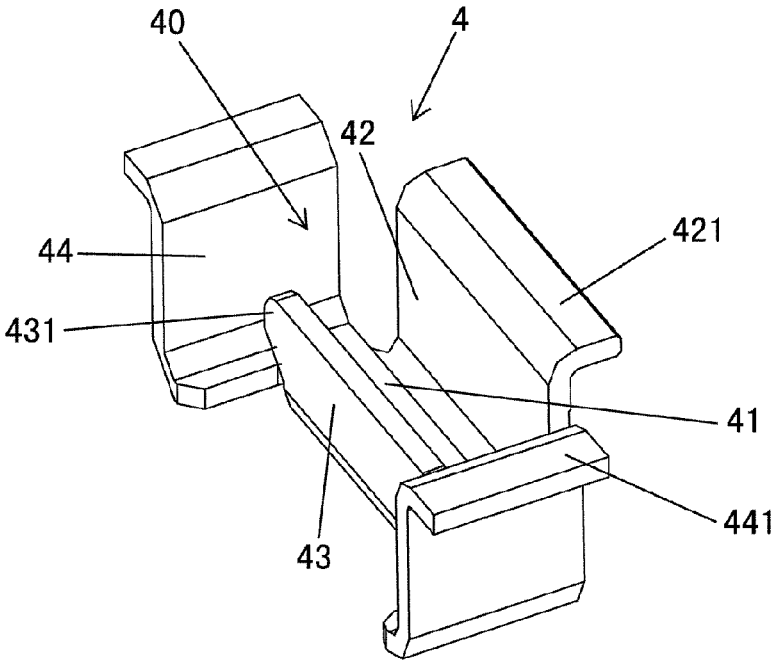
FIG. 11 is another perspective schematic view of the mating terminal of FIG. 9.

Further, as shown in FIGS. 3, 7 and 11, two holding slots 54 are provided along inner sides of the mating lateral frame 52. Two holding protrusions 431 are formed at both sides of the second mating lateral arm 43 of the mating terminal 4. The holding protrusions 431 are inserted into the holding slots 54, respectively, which cause the inner walls of the holding slots 54 to deform elastically, so that the mating terminal 4 is held tightly in the mating housing 5.

Figure 13:
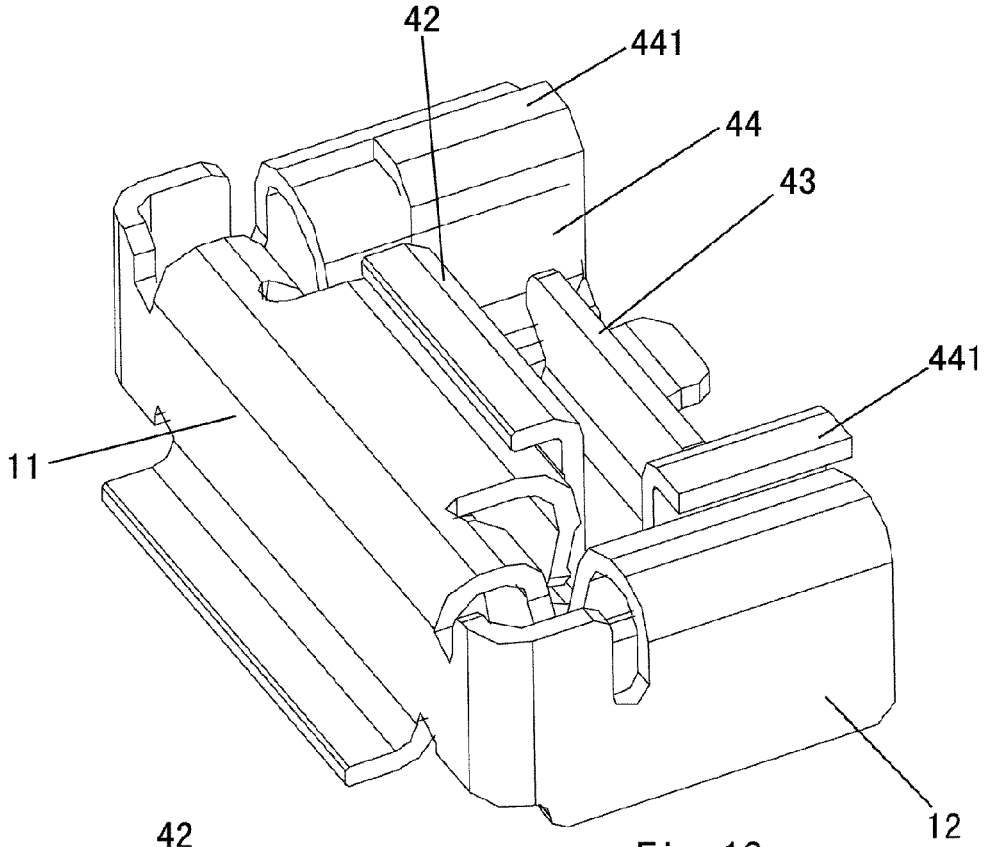
FIG. 13 is a perspective view of the terminal engaged with the mating terminal according to the invention.
Figure 14:
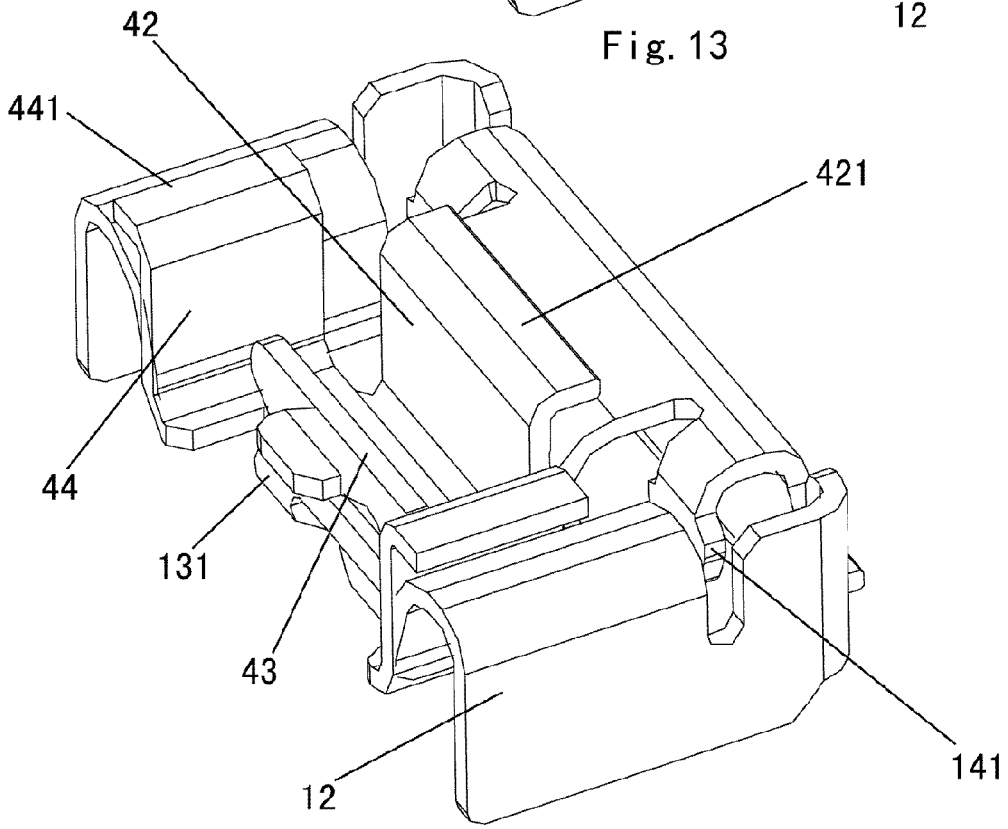
FIG. 14 is another perspective view of the terminal engaged with the mating terminal according to the invention.
Figure 15:
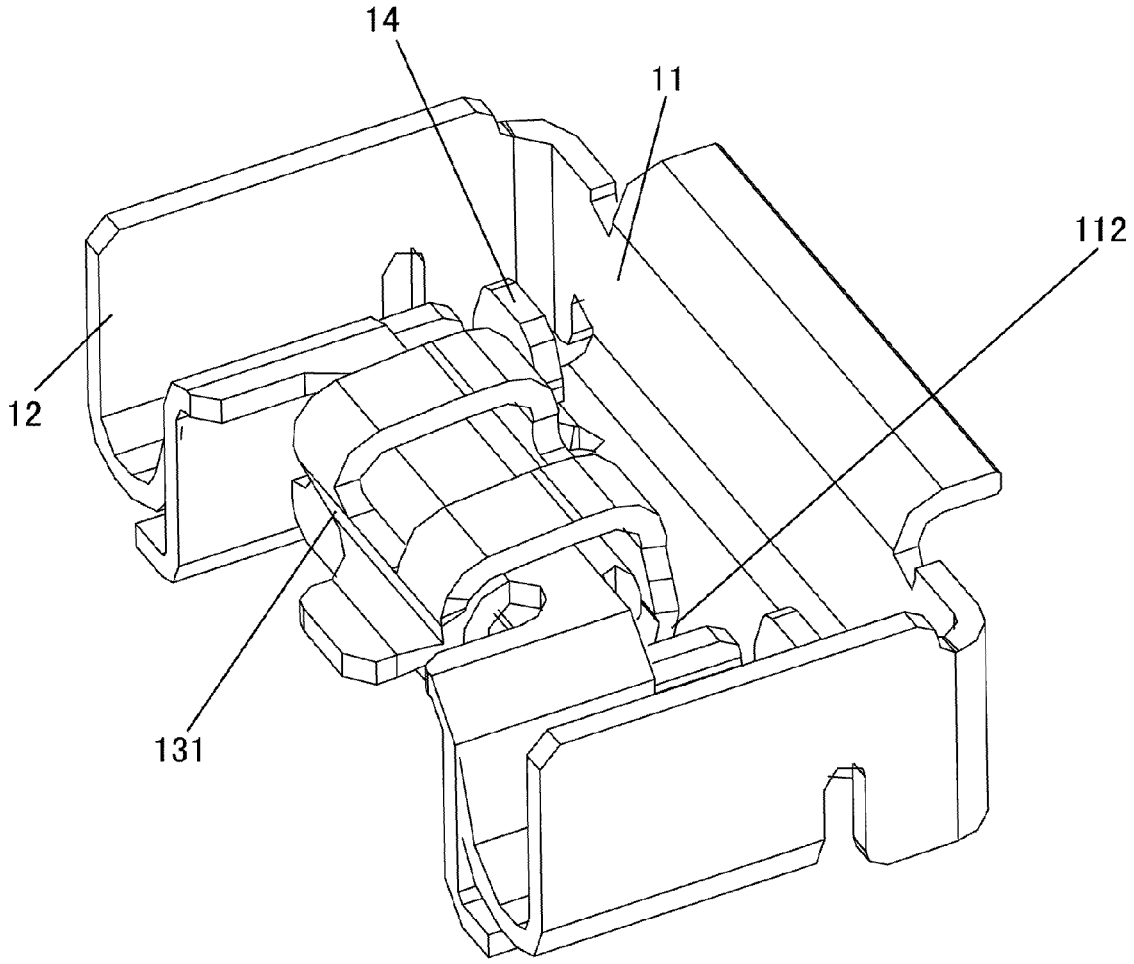
FIG. 15 is a bottom perspective view of the terminal engaged with the mating terminal according to the invention.

In addition, in the mating terminal 4, a free end of the first mating lateral arm 42 is bent outward to form a first holding part 421, a free end of each mating extending arm 44 is bent outward to form a second holding part 441. As shown in FIGS. 13 and 14, when the mating terminal 4 is mounted in the receptacle terminal 1, the first holding part 421 and the second holding part 441 are rested on the bases of the first U-shape section and the second U-shape section of the receptacle terminal 1, respectively, so that a three-point mechanical contact is formed between the mating terminal 4 and the receptacle terminal 1 to ensure the stability of mounting position there between. The mechanical contact section may also form an electric contact section, meanwhile, the first, second and third electric contact sections are formed between the receptacle terminal 1 and the mating terminal 4, that is, four electric contact sections are formed, the capacity of current transmission from the mating terminal 4 to the receptacle terminal 1 is thus increased, for example, a large current more than 15 A (ampere) can be transmitted. Further, the first holding part 421 and the second holding part 441 may also be used as welding parts through which the mating terminal is connected with the mating circuit board (not shown).

Referring now to FIGS. 1, 2, 5 and 6, the receptacle connector 100 further includes a plurality of data terminals 6 for transmitting data signals, which are mounted on the longitudinal frame 23 of the looped frame. A plurality of elastic pieces 61 are mounted in at least one sides of the boss 24. The elastic pieces 61 may or may not be set to connect electrically with data terminals 6.

Correspondingly, as shown in FIGS. 3, 4, 7 and 8, the plug connector 200 includes a plurality of mating data terminals 7 mounted on the mating longitudinal frame 53. When the plug connector 200 is engaged with the receptacle connector 100, the boss 24 of the plug connector 200 is received in the mating receiving part 55 of the plug connector, and the looped frame of the plug connector 200 is disposed between the boss 24, the lateral frame 22 and the longitudinal frame 23 of the receptacle connector 100, meanwhile, the receptacle terminal 1 and the data terminals 6 of the receptacle connector are connected electrically with the mating terminal 4 and the mating data terminals 7 of the plug connector respectively, so that a board-to-board electric connection between the circuit board mounted on the receptacle connector 100 and the mating circuit board mounted on the plug connector 200 is achieved.

In the embodiments of the invention, the receptacle terminal 1 and the mating terminal 4 may be formed of a single conductive metal piece such as copper or the like, for example, by shearing, punching, bending process.

According to another embodiment of the invention, a receptacle terminal 1 is provided and 1 is mounted in the housing 2 of the receptacle connector 100, the receptacle terminal 1 is formed of the metal piece and includes the first U-shape section 111 having the downward opening and the two extending arms 12. The first U-shape section 111 includes the base 11 and the first lateral arm 112 facing with the base 11. The two extending arms 112 are bent substantially perpendicularly towards the first lateral arm 112 at both lateral ends of the base 11.

Further, in an embodiment of the receptacle terminal 1, the second U-shape section 121 includes a downward opening and is bent along an upper side of each extending arm 12. The terminal further includes the third U-shape section 13 which is bent outward the first lateral arm 112 located in the inner side of the first U-shape section 111 and has the upward opening.

The terminals, receptacle connectors and electric connector assembly according to the above various embodiments of the present invention may maintain an excellent electric connection between the terminal of the receptacle connector and the mating terminal of the plug connector. Further, the terminals according to the invention may transmit a larger current, the capacity of current transmission by board-to-board connectors is thus increased.

It should be understood by those skilled in the art that the above embodiments is only exemplary, and those skilled in the art may modify these embodiments, the structures described in various embodiments can be combined in any manner in the case that there is no confliction between the structures or principles, thus, based on solving the technical problems of the present invention, more various types of terminals, receptacle connectors and electric connector assemblies are provided.

After the preferable embodiments of the present invention are described in detail, it would be appreciated by those skilled in the art that various changes or modifications may be made in these embodiments without departing from the principles and spirit of the disclosure and the present invention is not limited to these preferable embodiments. It should be noted that, the term "comprising" or "comprise" should be understood as not excluding other elements or steps, the word "a" or "an" should be understood as not excluding plural of said elements or steps. In addition, any reference number in the claims should not be understood as limiting the present invention.

What is claimed is:

1. A receptacle terminal comprising:

a first U-shape section having a downward opening and having:

a base extending laterally thereof;

a first lateral arm facing the base; and a pair of extending arms bent substantially perpendicularly towards the first lateral arm at both lateral ends of the base;

a second U-shape section having a downward opening bent from an upper side of each of the pair of extending arms; and a third U-shape section bent outward from the first lateral arm and having an upward opening.

2. The receptacle terminal of claim 1, further comprising a planar contact section bent outward from a lower side of the base opposite to the first lateral arm.

3. A receptacle connector comprising:

a housing having:

a bottom having a substantial rectangle shape;

a looped frame extending from a periphery of the bottom and defining a plug connector receiving section; and a terminal having a first U-shape section having a downward opening and covering a lateral frame of the looped frame and having;

a base extending laterally thereof;

a first lateral arm facing the base; and a pair of extending arms bent substantially perpendicularly towards the first lateral arm at both lateral ends of the base and resting against outer sides of longitudinal frames of the looped frame, respectively;

a second U-shape section having a downward opening bent along an upper side of the pair of extending arms; and a third U-shape section bent outward from the first lateral arm and having an upward opening.

4. The receptacle connector of claim 3, further comprising a plurality of restricting hooks disposed along outer sides of longitudinal frames.

5. The receptacle connector of claim 3, wherein the second U-shape section covers the looped frame.

6. The receptacle connector of claim 5, wherein the third U-shape section includes a second lateral arm positioned along an inner side of the first lateral arm and a second contact section formed on each of two facing sides of the first lateral arm and the second lateral arm.

7. The receptacle connector of claim 6, wherein a free end of the second lateral arm includes a tongue extending outward there from.

8. The receptacle connector of claim 7, further comprising a boss disposed at a center of the bottom of the housing.

9. The receptacle connector of claim 8, further comprising a gap formed between the periphery of the boss and the inner side of the looped frame.

10. The receptacle connector of claim 9, further comprising a restricting groove formed at both longitudinal ends of the boss.

11. An electric connector assembly comprising:

a receptacle connector having a housing with a bottom and a looped frame extending from a periphery of the bottom and defining a plug connector receiving section and a terminal with a first U-shape section having a downward opening and covering a lateral frame of the looped frame and having a base extending laterally thereof, a first lateral arm facing the base, and a pair of extending arms bent substantially perpendicularly towards the first lateral arm at both lateral ends of the base and resting against outer sides of longitudinal frames of the looped frame, respectively; and a plug connector mated with the receptacle connector and having a mating terminal mated with the terminal of the receptacle connector and a mating housing having a mating bottom and a mating looped frame extending upward from the periphery of the mating bottom, the mating terminal having a fourth U-shape section covering a mating lateral frame of the mating looped frame.

12. The electric connector assembly of claim 11, wherein the fourth U-shape section includes a first mating lateral arm located along an outer side of the mating lateral frame.

13. The electric connector assembly of claim 12, wherein the plug connector is inserted into a receiving part of the receptacle connector and the first lateral arm of the first U-shape section electrical contacts the first mating lateral arm.

14. The electric connector assembly of claim 13, further comprising a second U-shape section having a downward opening bent from an upper side of the pair if extending arms and cover a longitudinal frame of the looped frame.

15. The electric connector assembly of claim 14, wherein the mating terminal further includes a pair of mating extending arms resting on outer sides of mating longitudinal frames of the mating looped frame.

16. The electric connector assembly of claim 12, further comprising a third U-shape section bent outward from the first lateral arm outward and having an upward opening.

17. The electric connector assembly of claim 16, wherein the third U-shape section includes a second lateral arm positioned along an inner side of the first lateral arm and a second contact section formed on each of two facing sides of the first lateral arm and the second lateral arm.

18. The electric connector assembly of claim 17, wherein a free end of the second lateral arm includes a tongue extending outward there from.

19. A receptacle terminal comprising:

a first U-shape section having a downward opening and having:

a base extending laterally thereof and including an engaging section bent inward and extending downward from the first U-shape section;

a first lateral arm facing the base; and a pair of extending arms bent substantially perpendicularly towards the first lateral arm at both lateral ends of the base, the engaging section positioned between the first U-shape section and the pair of extending arms.

20. The receptacle terminal of claim 19, further comprising an elastic protrusion disposed on the engaging section.

21. A receptacle connector comprising:

a housing having:

a bottom having a substantial rectangle shape;

a looped frame extending from a periphery of the bottom and defining a plug connector receiving section; and a terminal having a first U-shape section having a downward opening and covering a lateral frame of the looped frame and having;

a base extending laterally thereof and including an engaging section bent inward and extending downward from the first U-shape section;

a first lateral arm facing the base; and a pair of extending arms bent substantially perpendicularly towards the first lateral arm at both lateral ends of the base and respectively resting against outer sides of longitudinal frames of the looped frame, the engaging section positioned between the first U-shape section and the pair of extending arms.

* * * * *